United States Patent [19]

Howard

[11] 4,079,767

[45] Mar. 21, 1978

[54] BAG CONSTRUCTION

[76] Inventor: Langhorne M. Howard, 168 Tradd St., Charleston, S.C. 29401

[21] Appl. No.: 698,756

[22] Filed: Jun. 22, 1976

[51] Int. Cl.[2] ..... B65D 33/24

[52] U.S. Cl. ..... 150/3; 24/DIG. 18; 224/5 R; 224/28 A

[58] Field of Search ..... 150/1, 3, 7, 33; 248/205 R; 24/DIG. 18, 204; 224/26 R, 26 B, 26 C, 26 D, 26 G, 26 H, 26 K, 5 R, 5 H, 28 A

[56] References Cited

U.S. PATENT DOCUMENTS

| | | | |
|---|---|---|---|
| 1,689,396 | 10/1928 | Lang | 224/26 H |
| 3,203,551 | 8/1965 | Van Loan, Jr. | 150/7 X |
| 3,446,420 | 5/1969 | Rinecker | 24/204 X |
| 3,557,853 | 1/1971 | Jones | 150/7 |
| 3,632,029 | 1/1972 | Sonner | 150/3 |
| 3,655,118 | 4/1972 | Rinecker | 150/3 |
| 3,747,171 | 7/1973 | Montague, Jr. | 24/204 |
| 3,826,296 | 7/1974 | Morris | 150/32 |
| 3,955,728 | 5/1976 | Jackson et al. | 150/33 |
| 4,022,361 | 5/1977 | Devlin | 224/26 R |

*Primary Examiner*—Stephen P. Garbe
*Attorney, Agent, or Firm*—Dennison, Dennison, Meserole & Pollack

[57] ABSTRACT

An open mouthed bag of flexible, preferably waterproof material having a pair of mating elongated fastener strips secured to the opposite inner surfaces thereof adjacent the open mouth for a complete sealing of the bag. A second pair of elongated mating fastener strips are utilized with one of these strips secured to the outer surface of the bag, generally adjacent the mouth thereof, and with the associated second strip releasably lockable with the first strip at all points of engagement therewith along the length thereof whereby a support member can be positioned between the first and second strips and the strips locked to each other about the support member for a mounting of the bag thereon.

5 Claims, 5 Drawing Figures

BAG CONSTRUCTION

The present invention relates to a general purpose bag, and is more particularly concerned with the provision of means for releasably mounting such a bag on a support structure of any type.

It is a primary object of the invention to provide a bag or bag-like carrier which can be utilized in substantially any situation wherein articles are to be securely retained yet readily accessible. In amplification of this object, it is intended that the carrier, in addition to having an open mouth capable of being selectively and completely sealed, incorporate releasable mounting means for a positive securement thereof to any of a variety of objects or supports.

As an example of some possible uses or adaptations of the invention, the bag, preferably formed of flexible waterproof material, can be used as a means for storing equipment on a boat with the carrier, through the unique releasable mounting capability thereof, being securely, athough releasably, attached to the mast. Likewise, the carrier can, through the same mounting means, be easily temporarily secured directly to clothing, such as the belt loops of a pair of trousers. In this manner, the carrier will be readily adaptable for use by hikers, hunters, fishermen, tennis players, golfers, and the like. The carrier can also attach to various equipment, such as tennis rackets and golf bags or golf carts. One particularly useful adaptation of the bag is its use as a carrier which can be releasably secured to crutches or other such aides for assisting the infirm. Other uses too numerous to enumerate will readily occur from the detailed description of the invention as set forth herein.

The invention comprises an open mouth bag, preferably of flexible waterproof material, having matable fastener strips secured to the opposed inner surfaces of the bag at the mouth for a selective closing of the mouth. A similar pair of fastener strips are provided exteriorly of the bag, one secured parallel to and adjacent the mouth of the bag and the second separably secured to the first strip and adapted to encircle a supporting object or article for an engagement of the first strip to the opposite sides thereof. The fastener strips provide continuous mating surfaces and are preferably of the type utilizing a first strip of closely spaced hooks or barbs and a second strip of fibrous loops. One example of such fasteners is sold under the trademark VELCRO. Utilizing fasteners of this type, wherein the engaging surfaces are continuous, the supporting structure, be it a crutch, belt loop, sailboat mast, or the like, can be tightly encircled and frictionally clamped by an engagement of the mating fastener strips as close thereto as possible to the opposite sides thereof.

The following patents constitute the known prior art, U.S. Pat. Nos.: 3,203,551, Van Loan, Jr.; 3,446,420, Rinecker; 3,557,853, Jones; 3,632,029, Sonner; 3,655,118, Rinecker; 3,826,296, Morris.

Attention is now directed to the accompanying drawings forming a part hereof wherein like numerals refer to like parts throughout, and in which.

Figure 1:
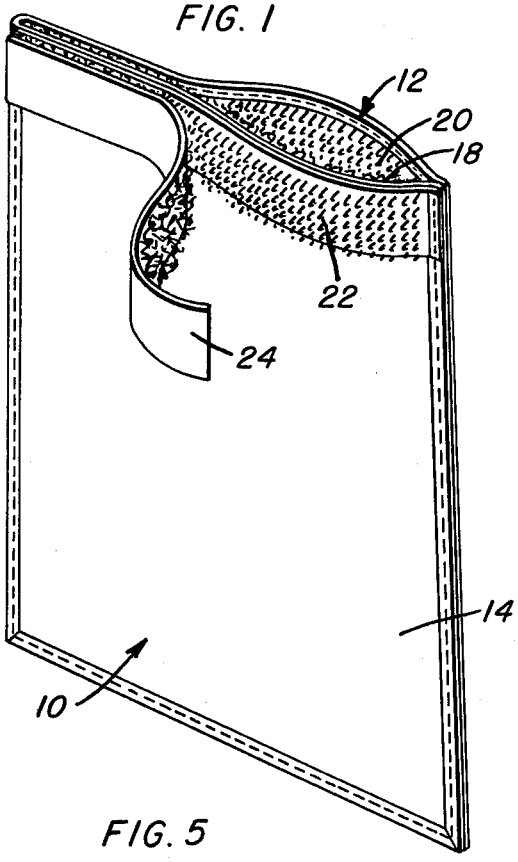
FIG. 1 is a perspective view of the carrier comprising the present invention.

Referring now more specifically to the drawings, reference numeral 10 is used to generally designate the bag or carrier bag comprising the present invention. This bag 10 will preferably be formed of a waterproof material and include a selectively closable open mouth 12 along one edge thereof. In addition, if deemed advisable, one or both of the side panels 14 can be gusseted as at 16 for increasing the carrying capability thereof.

A mating pair of fastener strips 18 and 20 are secured in any appropriate manner, such as by sewing, adhesive, etc., to the inner surfaces of the side panels 14 in aligned opposed orientation relative to each other immediately inward of the open mouth 12 of the bag 10. The material of the fastener strips will normally consist of opposed pressure interlockable minute plastic hooks and loops. Such fasteners are commonly sold under the trademark VELCRO.

Figure 2:
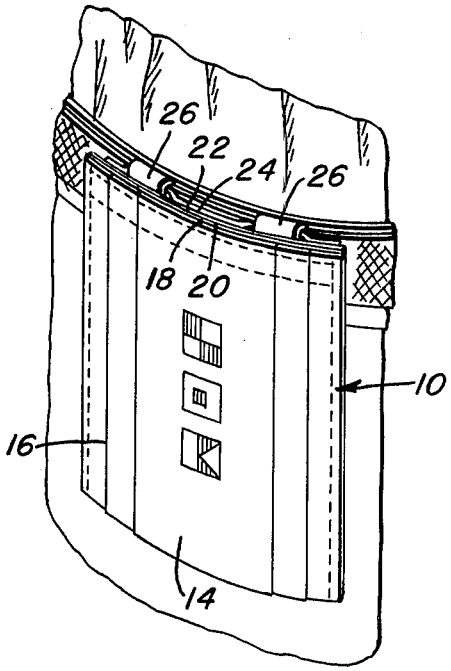
FIG. 2 illustrates the carrier mounted in supported position on trouser belt loops.
Figure 3:
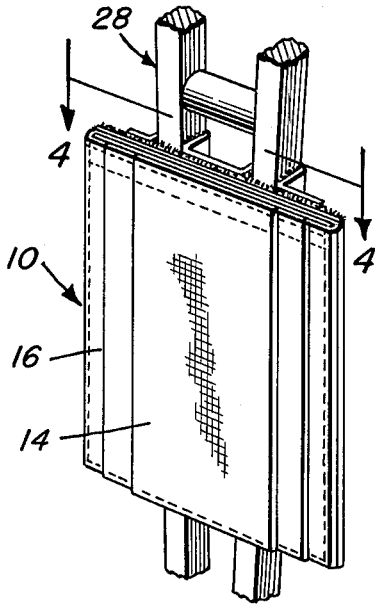
FIG. 3 illustrates the carrier mounted in supported position on a crutch.
Figure 5:
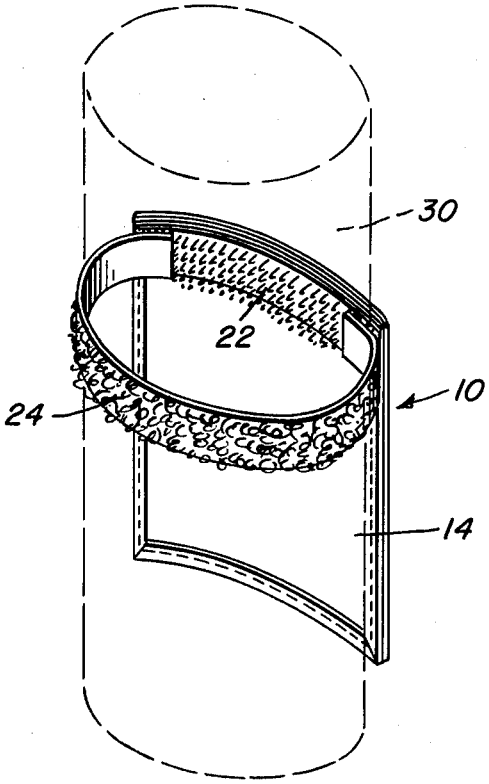
FIG. 5 illustrates the carrier mounted in supported position on a mast.
Figure 4:
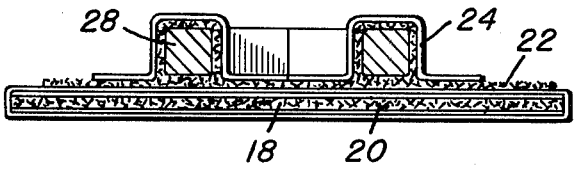
FIG. 4 is a cross sectional view taken substantially on a plane passing along line 4—4 of FIG. 3.

A second pair of fastener strips 22 and 24 are also utilized in conjunction with the bag 10. This second pair of fasteners 22 and 24 are specifically provided for the releasable mounting of the bag 10 to any convenient structure, support or the like. In this regard, attention is directed to the mounting of the bag on trouser belt loops 26 in FIG. 2, the mounting of the bag on crutches 28 as detailed in FIGS. 3 and 4, and the mounting of the bag on a sailboat mast 30 as shown in FIG. 5. In each instance, only three of the many anticipated ways of utilizing the fastener strip mounting arrangement, the bag is supported securely and safely while leaving the user's hands free for other tasks, and without providing any encumbrance on the support.

With regard to this second pair of fasteners, the fastener strip 22 is permanently affixed to the outer surface of one of the side panels 14 of the bag 10 substantially coextensive with the strip 18 or 20 secured to the inner surface of that same side panel 14. The second fastener strip 24 normally the strip incorporating the continuous surface of minute loops is only secured to the bag through an interlocking engagement with the mating bag mounted strip 22. In this manner, the strip 24 of a flexible material as is the strip 22 and all of the remaining components, can be wrapped around a support article in a manner so as to snugly encompass the article and engage the bag mounted strip 22 to the opposite sides thereof. The flexible nature of the strips 22 and 24, in addition to the ability of the strips 22 and 24 to positively interlock at any point of engagement therebetween, enables a positive tight clamping of the bag 10 to the support whereby any accidental release or movement relative to the support is effectively avoided. In this regard, it will be appreciated that the substantially infinite points of interlock provided between the strips 22 and 24 along the length thereof, within the limitations of the lengths of the strips, enable an accommodation of the bag to substantially any type of support which the strip 24 either alone or in combination with a flexing of the bag strip 22 can encircle.

From the foregoing, it should be appreciated that an unique container or bag construction has been defined. This construction results in the provision of a container which can be utilized as a carrier for an endless variety of goods with the carrier itself readily releasably attachable to any convenient support structure including, in addition to those previously referred to, beach umbrellas, bicycles, backpacks, etc.

The foregoing is illustrative only of the principals of the invention, and as modifications and changes may occur to those skilled in the art it is not desired to limit the invention to the exact construction and operation shown and described. Accordingly, all suitable modifications and equivalents may be resorted to falling within the scope of the invention as claimed.

I claim:

1. Selectively mountable container means comprising an article receiving carrier, said carrier having first elongated pressure responsive fastener means affixed thereto along an exterior portion thereof, and second elongated flexible pressure responsive fastener means being linear and having opposed free ends, said second fastener means being dimensioned to be coextensive with at least a substantial portion of the first means and engaged with said carrier solely by a releasable pressure mating with the first means along all portions of the length of the first means engaged by the second means, said second means being selectively positionable in conforming engagement with and about a support structure with the second means engaged with the first means to the opposite sides of the encircled support structure.

2. The container means of claim 1 wherein said carrier includes a selectively closable mouth, and fastener means mounted on said carrier at said mouth for a selective closing of the mouth.

3. The container means of claim 2 wherein said pressure responsive fastener means comprise a pair of elongated flexible fastener strips mounting selectively interlockable complimentary resilient hooks and loops.

4. The container means of claim 3 wherein the fastener strip comprising the first elongated pressure responsive fastener means is affixed to the carrier generally parallel to and adjacent the mouth thereof.

5. The container means of claim 1 wherein said pressure responsive fastener means comprise a pair of elongated flexible fastener strips mounting selectively interlockable complimentary resilient hooks and loops.

* * * * *